United States Patent [19]

Barney

[11] 4,374,017

[45] Feb. 15, 1983

[54] HEAT FLUX CONTROL TECHNIQUE

[75] Inventor: John H. Barney, Golden, Colo.

[73] Assignee: Tosco Corporation, Los Angeles, Calif.

[21] Appl. No.: 200,395

[22] Filed: Oct. 24, 1980

[51] Int. Cl.[3] ..... C10G 1/02

[52] U.S. Cl. ..... 208/11 R

[58] Field of Search ..... 208/11 R

[56] References Cited

U.S. PATENT DOCUMENTS

| | | | |
|---|---|---|---|
| 2,872,386 | 2/1959 | Aspegren | 202/136 |
| 3,020,227 | 2/1962 | Nevens | 208/11 R |
| 3,034,979 | 5/1962 | Nevens | 208/11 R |
| 3,265,608 | 8/1966 | Crawford | 208/11 R |
| 3,925,190 | 12/1975 | Whitecombe | 208/11 R |

*Primary Examiner*—T. M. Tufariello

*Attorney, Agent, or Firm*—Poms, Smith, Lande & Rose

[57] ABSTRACT

In processes for retorting oil shale using recycled heat carrying ceramic balls having a critical heat flux value, efficient operation, without heat shock damage to the balls, is obtained by operating at a weight ratio of balls to shale which is greater than but substantially equal to the ratio corresponding to the critical heat flux value; and this ratio is a function of both the heat transfer coefficient at the inlet to the retort and also the difference in temperature between the heat carrying balls and the oil shale. Implementing apparatus includes arrangements for controlling the ratio of heat carrying balls to shale, as by ball feed control apparatus and/or oil shale feed control apparatus, in accordance with the difference in temperature between the ceramic balls and the shale.

9 Claims, 3 Drawing Figures

HEAT FLUX CONTROL TECHNIQUE

FIELD OF THE INVENTION

This invention relates to retorts in which carbonaceous material is retorted through the use of heat carrying solids, and more particularly to the retorting of oil shale using recycled heat carrying ceramic balls.

BACKGROUND OF THE INVENTION

It has previously been proposed to retort oil shale and other carbonaceous material in a rotating retort by the use of recycled heat carrying solids such as ceramic balls, which are supplied to the rotating retort together with the carbonaceous material. As the very hot balls engage the cooler pre-heated oil shale, the oil shale temperature is raised to a point at which volatile and combustible gases are driven off and collected. Typical prior art patents which disclose processes of this type include U.S. Pat. No. 2,872,386 granted Feb. 3, 1959; No. 3,020,227, granted Feb. 6, 1962; No. 3,265,608, granted Aug. 9, 1966; and No. 3,925,190, granted Dec. 9, 1975.

With regard to the ratio of balls to oil shale which is employed, up to the present time this has been handled on a rather hit or miss basis, without a thorough study of the optimum ratio of the balls or other heat carrying solids to the weight of oil shale, at the particular temperatures which were employed.

With regard to the use of ceramic balls, a persistent operational problem has been the tendency for the balls to crack, chip and break under severe operating conditions. As a result, some operators preferred not to use a difference in temperature between the hot recycled balls and the oil shale feed which exceeded a certain preconceived temperature difference, on the basis that the thermal shock as each ball encountered the cold or cool oil shale would crack the ceramic balls or cause surface chips if too great a temperature difference were present, regardless of the heat transfer coefficient of the system.

Accordingly, it is a principal object of the present invention to determine precisely the factors going into the chipping or breakage of heat carrying solids and to operate retorts on a high efficiency basis, by maximizing heat transfer characteristics of the retorting process through the use of the minimum ratio of the heat carrying solids to oil shale or other carbonaceous material which is being retorted, consistent with maintaining low breakage.

SUMMARY OF THE INVENTION

In accordance with broad features of the invention, it has been determined that the optimum ratio of recyclable heat carrying solids to carbonaceous material in a retort of the type in which these two materials are brought into heat transferring relationship with one another, is dependent on (1) the critical heat flux as measured at the surface of the heat carrying solids, a value above which significant cracking will take place, and which is in turn dependent primarily upon the material of construction and configuration of the heat carrying solids, (2) the heat transfer coefficient at the inlet of the retort, and (3) the actual difference in temperature between the reheated heat carrying solids and the carbonaceous material being fed to the retort. Thus, it may be noted that there is not a critical temperature difference at which the heat carrying solids or balls will crack when they encounter the oil shale; instead, it is a composite function involving collectively the temperature difference between the ceramic balls and the carbonaceous material, the heat transfer coefficient, and also the critical heat flux of the ceramic balls. By increasing the weight ratio of heat carrying solids to carbonaceous material, the flux may be reduced to below the critical value, and the cracking and ultimate chipping or breaking of the ceramic balls may be retarded or eliminated. However it has been found that increasing the weight ratio of heat carrying solids to carbonaceous material decreases the overall heat transfer coefficient which translates into less desirable heat transfer characteristics and at the extreme into less economical operation.

The method of the present invention contemplates maintaining the weight ratio of the recycled heat carrying bodies to the carbonaceous material being retorted at a level which is greater than, but substantially equal to the critical value of the ratio for the temperature difference present at the inlet of the retort at each point in time, where the critical value of the weight ratio is a function collectively of the critical heat flux of the heat carrying bodies, the heat transfer coefficient at the inlet of the retort, and also of the difference in temperature between the heat-carrying bodies and carbonaceous material entering the retort.

The apparatus of the present invention contemplates determination of the temperature of the carbonaceous material as it enters the rotating retort or other heat transfer apparatus, and control of the reheat temperature of the ceramic balls or other recyclable heat transferring members. The apparatus includes arrangements for controlling the rate of flow of the ceramic balls or the rate of flow of the oil shale, or other arrangements for controlling the weight ratio, in accordance with the temperature difference. In this way, the retort may be operated at optimum efficiency without chipping or fracturing the heat carrying balls as a result of thermal shock; and this will be true despite significant variations in the temperature of the incoming shale or the recycled balls, which might otherwise cause chipping or fracturing of the recycled heat carrying solids. Further, with this type of control, higher efficiencies may be achieved because the margins of safety normally employed in the process to guard against temperature fluctuations or the like, need not be maintained.

Other objects, features and advantages of the present invention will become apparent from a consideration of the following detailed description and from the accompanying drawings.

DETAILED DESCRIPTION

Figure 1:
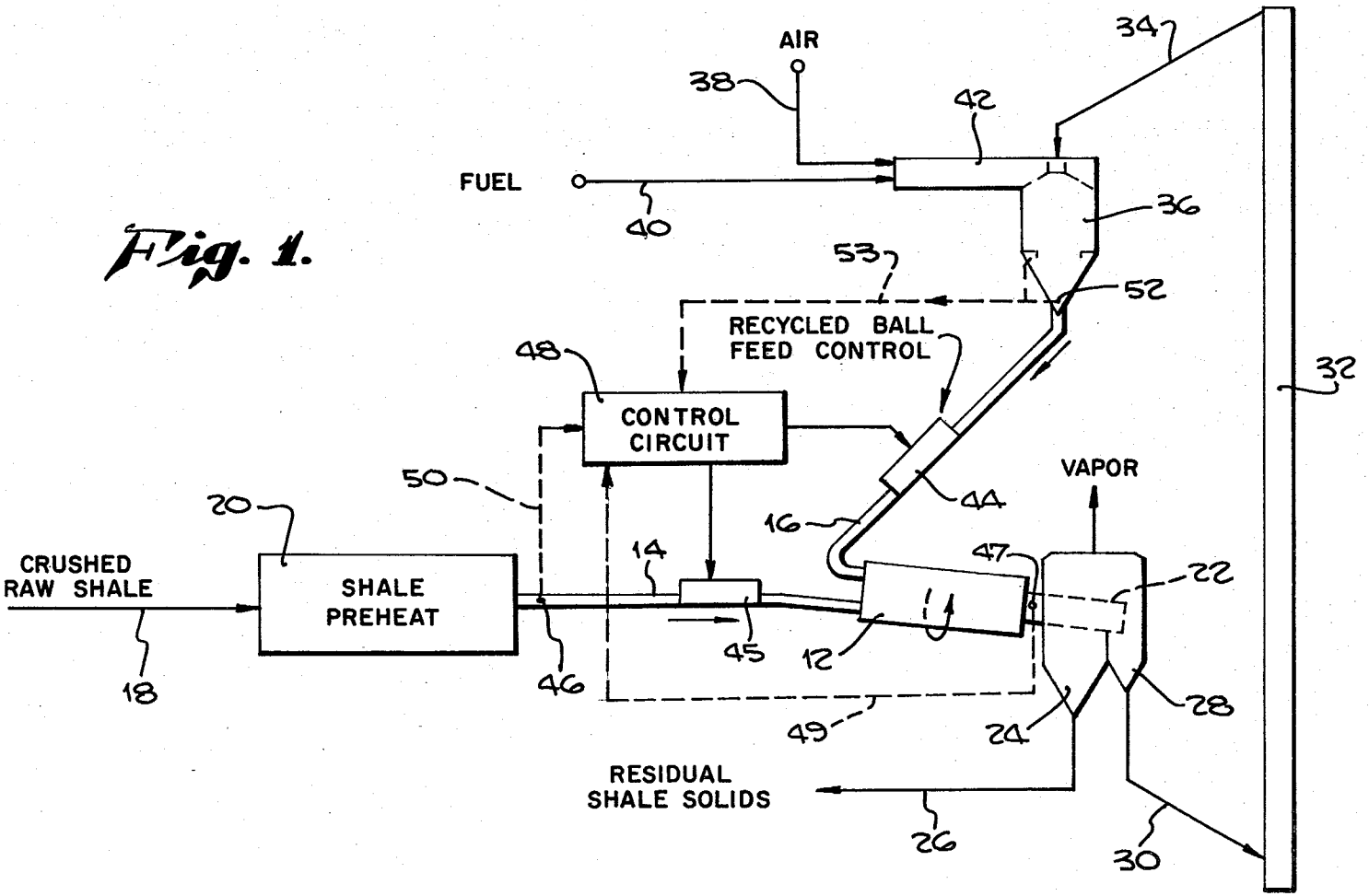
FIG. 1 is a diagrammatic showing of a system illustrating the principles of the invention.

Referring more particularly to the drawings, FIG. 1 is a block diagram of one illustrative system embodying the principles of the invention. A central portion of the invention is the rotating retort 12 to which crushed oil shale is supplied as indicated by the path 14, and to which recycled heat carrying solids, in the form of small ceramic balls are also supplied, over line 16. The crushed raw shale input is indicated by the arrow 18, and conventional preheating arrangements for the shale are represented by the block 20.

Concerning the retort 12, a trommel, or rotating cylindrical screen, 22 is employed at the output of the retort to separate the oil shale residue from the recycled ceramic balls. In this connection, the balls might typically be in the order of ½ inch in diameter, and the shale would be crushed to a diameter less than this ½ inch diameter of the balls. The openings in the trommel or screen 22 would be in the order of ½ inch or slightly less, so that the residual oil shale particles will drop through the screen 22 into the accumulator 24. The line 26 indicates the carrying away of the accumulated residual shale solids for processing. The accumulator 28 receives the ceramic balls which roll through and out the open end of the trommel 22. The ceramic balls are routed via a line 30, elevator 32, and line 34 to the ball heating apparatus 36, which reheats the ceramic balls to an elevated temperature. In this connection, air and fuel are supplied over lines 38 and 40, respectively, to the combustion chamber 42, and the incoming balls from line 34 are exposed to the resultant heat.

The weight ratio of the recycled balls or other heat carrying members to the weight of the oil shale being processed may be varied or determined in any desirable way. In the illustrative embodiment shown in FIG. 1, a feed control unit 44 is provided to vary the number of balls which are permitted to pass through line 16 to the retort 12 in a given period of time. Another feed control unit 45 is provided to vary the quantity of crushed shale being fed to the retort 12 through the line 14 from the preheater 20. Thus, the ratio of balls to shale may be easily varied.

The temperature of the preheated oil shale is sensed at point 46, and an electrical signal indicating the temperature at this point is transmitted to the control and monitor circuit 48 over the control lead 50, shown in dashed lines to distinguish it from the feed lines in this diagram. Similarly, the temperature of the recyclable ceramic balls is sensed at point 52 and a corresponding electrical signal is routed to control circuit 48 over line 53. If desired, instead of sensing at points 46 and 52, the temperature of the oil shale and the ceramic balls may be sensed at the point where the lines 14 and 16 supply the shale and ceramic balls directly to the rotating retort 12.

Preferably, the temperature of the retorted shale is sensed at point 47, or another convenient location at the discharge of the retort, and a corresponding electrical signal is similarly routed to control circuit 48 over line 49. By providing the control circuit 48 with input and output temperatures and with appropriate circuitry, control of the retorting process may be achieved by maintaining an appropriate heat balance for the retort. As an example, if the air and fuel supplied to the ball heating apparatus 36 through lines 38 and 40, respectively, is held constant, the recycled ball feed control 44 may be utilized to maintain a constant reheated ball temperature at point 52. Under equilibrium conditions, a constant flow rate of heat-carrying balls will be maintained. Coincidentally, the feed rate of raw shale may be varied to maintain a constant, predetermined shale discharge temperature at point 47. In response to minor variations in the temperature of the raw shale feed, as sensed at point 46, control circuit 48, in one preferred embodiment, increases or decreases the raw shale flow rate to maintain the desired discharge temperature at point 47 which will correspond to the appropriate ratio of heat-carrying balls to shale.

The ball feed control unit 44 and the shale feed control unit 45 may be of any desired form, and either or both could, for example, involve the use of a variable speed electric motor with an associated feedscrew, a flapper valve assembly as disclosed in U.S. Pat. No. 3,550,904 or any suitable valving structure which would accurately regulate the amount and the corresponding weight of the ceramic balls or carbonaceous material supplied to the retort.

Of course, if the temperature of the oil shale and the ceramic balls is essentially constant, the feed rates of ceramic balls and oil shale may also be held constant. Given these assumptions, step changes in the flow rate of ceramic balls or oil shale would be necessary if changes were introduced which would affect either the value of the critical heat flux or the heat transfer coefficient of the system. Such changes might include, for example, a change in the heat carrying bodies (i.e., dimensionally or with respect to material of construction), a change in the rotational speed of the retort, a change in the type of carbonaceous feed being processed, or changes in the configuration of the inlet section of the retort. Each such change may require a change to effect a new optimum ratio of ceramic balls to carbonaceous material.

Figure 2:
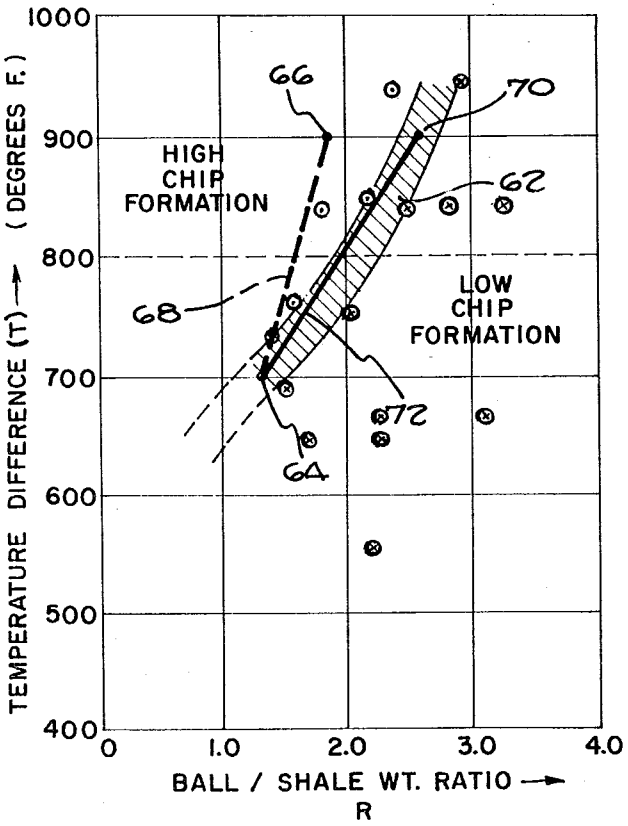
FIG. 2 is a diagram showing the ball/shale weight ratio plotted against the difference in temperature between the recycled balls and the oil shale being retorted.

Reference will now be made to FIG. 2 in which the ball to shale ratio is plotted against the temperature difference in degrees Fahrenheit of the hot balls from the ball heater and the preheated raw shale. Initially, attention is directed to the raw data indicated by the circles with dots in them and the circles with X's in them. The X's which generally appear to the right of the shaded area 62 represent test runs in which the ceramic balls did not chip or crack to any great degree as a result of the heat shock. However, the circles which have merely dots at their centers which appear mostly to the left of the shaded area 62, represent areas of high chip "make", or of high chip or crack formation. The shaded area 62 which lies between the array of X's and the array of dots, represents the experimentally determined optimum area where there is very little chip or crack formation and where there is the minimum ratio of recyclable heat bodies or balls for a given amount of shale. In the present system, by reducing the number of balls which are required to retort a given amount of shale, the retorting process becomes more economical. Viewed in another light, more shale could be retorted in a given apparatus, or the same amount of shale could be retorted in a smaller apparatus.

As mentioned above, it might logically be thought that below a predetermined temperature difference, there might be no, or very little, chip or crack formation, while above a certain temperature difference it might be expected that there would be high chip formation. That would, of course, conform to a horizontal line in the showing of FIG. 2, and that obviously is not the case, as indicated by the experimental data. Further analysis will indicate that, in fact, the chip formation is a function collectively of the temperature difference, the critical heat flux value of the ceramic balls, and the heat transfer coefficient of the recycled ceramic balls to the oil shale at the inlet to the retort. On a qualitative basis, this means that if a single ceramic ball were to be dropped into a body of oil shale with a predetermined temperature difference between the ball and the shale, it would be much more likely to be chipped, cracked or fractured as a result of heat shock than when there are a large number of ceramic balls which are each contributing a smaller portion of the total heat to the oil shale with which they become associated.

Figure 3:
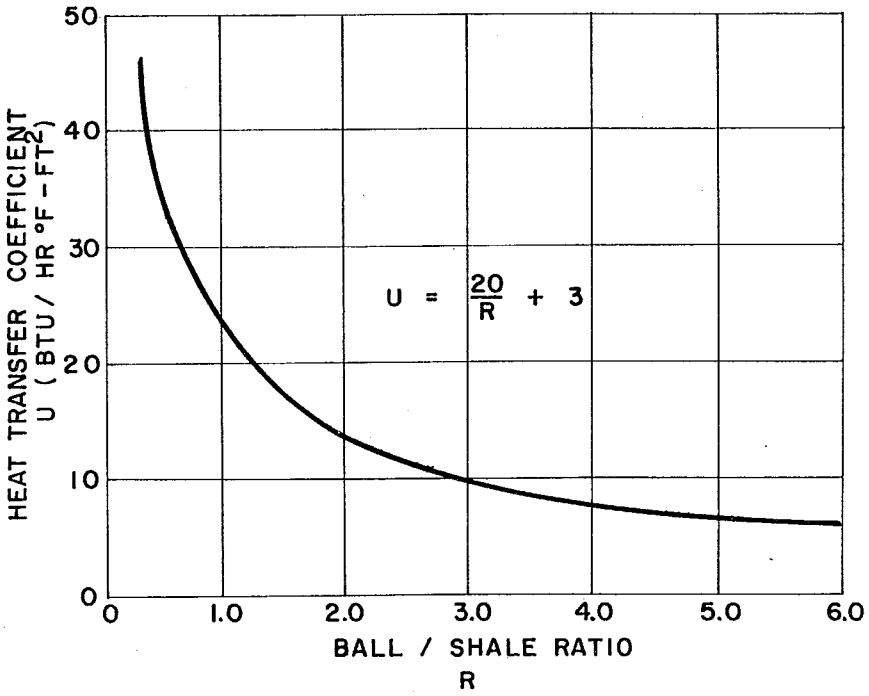
FIG. 3 is a plot of the overall heat transfer coefficient at the inlet to the retort plotted against the ball/shale ratio.

Now, examining this phenomenon more closely, FIG. 3 is a plot of the measured heat transfer coefficient at the inlet to a retort operating under conditions as generally described herein, plotted against the ball/shale ratio. To a first approximation, the relationship between the heat transfer coefficient "U" and the ball/shale weight ratio "R" is as follows:

$$U=(20/R)+3 \quad (1)$$

For purposes of an initial or preliminary analysis, it was assumed that the chipping was a direct result of exceeding a critical heat flux value. The heat flux is equal to the heat rate "Q" divided by the area "A" through which the heat is transferred, and, using the convection heat transfer equation, is equal to the heat transfer coefficient U multiplied times the temperature difference "T" between the recycled ceramic balls and the shale. Note particularly that for convenience in manuscript preparation and printing, the symbol "T" represents temperature difference, and not merely the temperature. Accordingly, $$Q/A=U\times T \quad (2)$$

Now, assuming that there is a maximum or critical flux below which little or no breakage or chipping occurs, designated $F_c$, then at such critical point $$F_c=U\times T \quad (3)$$

Now, substituting from equation (1), $$F_c=\left(\frac{20}{R}+3\right)T \quad (4)$$

$$T=\frac{F_cR}{20+3R} \quad (5)$$

FIG. 2 is now employed to solve for $F_c$, by noting that, at a temperature difference of 700 degrees $F_c$, the critical ball-to-shale ratio, is equal to 1.35 (see point 64 in FIG. 2). Now, solving equation (4) for $F_c$:

$$F_c=\left(\frac{20}{1.35}+3\right)700=12{,}470 \quad (6)$$

Equation (5) then becomes:

$$T=\frac{12{,}470\,R}{20+3R} \quad (7)$$

And equation (7) may be rewritten as follows:

$$R=\frac{20\,T}{12{,}470-3T} \quad (8)$$

Solving this equation (8) for R, using a temperature difference T of 900 degrees, the resultant ratio is about 1.84. This point 66 is plotted on FIG. 2, and indicates a characteristic extending generally along dashed line 68. From a consideration of the experminentally determined shaded zone 62, however, it appears that the critical temperature difference vs. ball/shale ratio characteristic is not dependent solely on the convection heat transfer relationship (i.e., the heat transfer coefficient). Instead, the characteristic is also a function of the absolute value of the temperature, perhaps resulting from a temperature dependence of the critical heat flux (Fc) or resulting from localized temperature differences. In the operating range shown in FIG. 2, this dependence involves an additional substantially linear factor which may be added to equation 8 as follows:

$$R=\frac{20\,T}{12{,}470-3T}+(T-T_o)\,0.0038 \quad (9)$$

where $T_o$ represents a temperature difference of 700 degrees, and corresponds to point 64 in FIG. 2. The additional linear factor was obtained from point 70 in FIG. 2 at a ball/shale ratio of 2.6, which is displaced to the right as shown in FIG. 2 by a value of about 0.758.

Accordingly, equation (9) is shown in FIG. 2 as being approximated by line segment 72 in the operating range under consideration; and this is confirmed by the values of R equal to 1.35 and 2.6 obtained by substituting the temperature differences of 700 degrees and 900 degrees, respectively, into equation (9).

Concerning the data employed in the preparation of FIGS. 2 and 3, the recyclable heat carrying solids were in the form of balls one-half inch in diameter and made principally of alumina, or aluminum oxide. The temperature of the balls as supplied to the rotating retort was in the range of 900 degrees F. to 1250 degrees F. In pilot plant operation the rotating retort is about 2 feet to 5 feet in diameter, while in commercial operations, a diameter in the order of 12 feet to 14 feet could be used. The speed of rotation was in the order of two to five revolutions per minute.

Now, it is considered appropriate at this point to discuss the control and monitor circuitry 48 and its mode of operation. As mentioned above, the temperature may be sensed at points 52 and 46 for the reheated balls and the preheated shale, respectively, or immediately at the input to the retort 12; and the temperature at point 47 at the output of the retort 12 is also sensed. Of course, there will be a small temperature drop between points 46 and 52 and the input to the retort 12, and a correction factor may be introduced to correct for these differences. For one exemplary set of steady state conditions, the temperature of the reheated balls was approximately 1250 degrees F., that of the shale was 500 degrees F. and the temperature at the output from the retort was approximately 900 degrees F. The difference between the two input temperatures was about 750 degrees F., and the ball-to-shale ratio was approximately 1.7, as shown in FIG. 2. With these parameters, and considering the heat losses in the retort and the heat content of the volatile products which are obtained from the retort, the output temperature at point 47, as mentioned above, is approximately 900 degrees F.

Now, the control and monitor circuit 48 may be operated in any of several modes to maintain the operating point of the process in the desired range, as indicated in FIG. 2. Specifically, the temperatures from points 52, 46 and 47 are displayed, so that drastic departures from normal values may be readily detected, and suitable repairs or adjustments made. Further, the control and monitor circuit 48 may be operated in a mode in which the reheated balls are fed at a uniform rate, and control is exercised by varying the rate of feed of the preheated shale by the feed control unit 45. This can be accomplished using a "forward" acting control sensitive to the recycled ball and the shale temperatures sensed at points 52 and 46, to provide a rate of feed for the shale (with a constant rate of recycled ball feed), to provide a ball/shale ratio on line 72 of FIG. 2 or slightly to the right of line 72, corresponding to a slightly greater ratio. The monitored temperature at point 47 will verify that the process is operating within the desired parameters.

Alternatively, with a predetermined temperature and rate of flow of recycled balls, the system may be operated as a servo or feed back system with a relatively long time constant (greater than the transit time through retort 12), and the shale flow through control unit 45 varied to produce the predetermined temperature at point 47 at the output of retort 12. If the temperature at point 47 increases, the rate of flow through control unit 45 will be increased, and vice versa. Further, through monitoring, verification of the correct operating point on or slightly to the right of line 72 in FIG. 2 may be confirmed. Also, for example, if the temperature of the preheated shale should decrease slightly, this change would have the initial effect of reducing the output temperature at point 47; the result would be to slow the feed of shale through control unit 45, thereby increasing the ball/shale ratio, as called for by the increased temperature difference, in accordance with FIG. 2. Similarly, of course, both the forward and feedback modes of operation can be readily implemented with the shale feed rate being held constant, and varying the recycled ball feed through control unit 44.

It is to be understood that the foregoing parameters merely represent one practical system for the retorting of oil shale, and that variations are to be expected for varying conditions and materials. For example, the feed control arrangements 44 and 45 may be combined with the ball and shale heating units 36 and 20, respectively. Also, different diameter ceramic balls, for example, of three-quarters and one-inch diameters, have been successfully used, with the crushed carbonaceous material being in each case of smaller size to facilitate separation. Materials which have been successfully retorted include rubber and coal, in addition to oil shale. In the case of retorting rubber without preheating, a much higher weight ratio of balls to the rubber was required in the order of 8 to 10:1 in part in view of the higher temperature difference between the reheated balls and the feed stock and the different heat transfer coefficient at the inlet of the retort.

In general, with each set of conditions, including the material to be retorted, the type of recyclable material, including composition and size of the balls, for example, a plot of the heat transfer coefficient versus the ratio of heat carrying bodies to carbonaceous material such as that shown in FIG. 3 should be prepared, from which the relationship between the ratio and the temperature difference may be calculated. Preferably the resulting mathematical relationship may be experimentally confirmed by a plot such as that shown in FIG. 2. Alternatively, the relationship between the ratio and the temperature difference may be determined solely by a plot such as that shown in FIG. 2. Then, the circuit 48 is provided with circuitry to implement and control the feed mechanisms 44 and 45 so that the ratio is maintained close to the optimum level. By this method the apparatus shown in FIG. 1 may be employed to control the retorting of a variety of materials, with different temperature difference ranges, under conditions which vary the heat transfer coefficient, and in each case an optimum ratio of the recyclable heat carrying solids to carbonaceous material to be retorted, is maintained.

Accordingly, the present invention is not limited to the precise conditions plotted and analyzed in detail in FIGS. 2 and 3, for example.

What is claimed is:

1. In an optimized method for retorting carbonaceous material, involving the addition of recycled heat-carrying bodies to carbonaceous material, and moving the carbonaceous material and recycled heat-carrying bodies in heat-transferring proximity with one-another to raise the temperature of the carbonaceous material to retorting heat levels, wherein the heat-carrying bodies have a critical weight ratio of recycled heat carrying bodies to carbonaceous material, below which chipping and cracking of such heat-carrying bodies may readily occur, the improvement comprising:

experimentally determining the critical weight ratio of recycled heat-carrying bodies to carbonaceous material, expressed as a continuously increasing function of temperature difference having a substantial positive slope with increasing temperature differences;

determining the difference in temperature between the recycled bodies and the carbonaceous material; and providing a weight ratio which is greater than but substantially equal to said critical value for the temperature difference present in the process.

2. A method as defined in claim 1 wherein said weight ratio is controlled by varying the rate of feeding said recyclable heat carrying bodies while maintaining the rate of feeding said carbonaceous material relatively constant.

3. A method as defined in claim 1 wherein said weight ratio is controlled by varying the rate of feeding carbonaceous material said while maintaining the rate of feeding said recyclable heat carrying bodies relatively constant.

4. A method as defined in claim 1 wherein the heat carrying bodies and the carbonaceous material are fed into a rotating retort, and wherein said carbonaceous material is crushed to a size smaller than said heat carrying bodies prior to entry into the retort.

5. In a method for retorting carbonaceous material involving the addition of recycled heat-carrying bodies to carbonaceous material and moving the carbonaceous material and recycled heat-carrying bodies combination to raise the temperature of the carbonaceous material to retorting heat levels, wherein the heat-carrying bodies have a critical heat flux value ($F_c$) above which chipping and cracking of such heat-carrying bodies may readily occur, the improvement which comprises:

controlling the weight ratio (R) of heat-carrying bodies to carbonaceous material at a value which is greater than but substantially equal to the critical value obtained by solving the following equations for R:

$$R=f(U)+K(T-T_o)$$

$$U=F_c/T$$

where T is the temperature difference between the heat carrying bodies and the carbonaceous material; K is an experimentally determined proportionality constant, determined by operating the process at different temperature differences with different weight ratios and observing the chip formation in each case; $T_o$ is an arbitrarily selected reference temperature difference; U is the heat transfer coefficient as a function of the weight ratio of recycled heat carrying bodies to carbonaceous material; and $F_c$ is the critical heat flux below which little or no breakage or chipping occurs.

6. A method as set forth in claim 5 wherein the temperature of said carbonaceous material fed to said retort is sensed, wherein the temperature of said recycled heat carrying bodies is sensed, and wherein said weight ratio is controlled in accordance with the difference in the sensed temperatures.

7. A method as set forth in claim 5 wherein the specific value of K is determined from a plot of the temperature difference (T) versus the ratio (R) at retorting conditions corresponding to a substantially constant heat transfer coefficient (U) and a heat flux for the heat-carrying bodies substantially equal to the critical heat flux value ($F_c$).

8. A method as set forth in claim 5 including the steps of sensing the temperature at the output of the retorting process, and controlling the ratio of heat-carrying bodies to carbonaceous material to maintain the output temperature at a predetermined level.

9. In an optimized method for retorting carbonaceous material, involving the addition of recycled heat-carrying bodies to carbonaceous material, and moving the carbonaceous material and recycled heat-carrying bodies in heat-transferring proximity with one-another to raise the temperature of the carbonaceous material to retorting heat levels, wherein the heat-carrying bodies have a critical weight ratio of recycled heat-carrying bodies to carbonaceous material, below which chipping and cracking of such heat-carrying bodies may readily occur, the improvement comprising:

experimentally determining the critical weight ratio of recycled heat-carrying bodies to carbonaceous material, expressed as a continuously increasing function of temperature difference having a substantial positive slope with increasing temperature differences;

determining the difference in temperature between the recycled bodies and the carbonaceous material;

providing a weight ratio which is greater than but substantially equal to said critical value for the temperature difference present in the process;

sensing the temperature difference between the recycled heat-carrying bodies and the carbonaceous material as the temperature difference is changed; and changing the weight ratio of recycled heat-carrying bodies to carbonaceous material to a new, different ratio when said temperature difference changes, said new ratio being greater than but substantially equal to the critical value for the new temperature difference.

* * * * *